US006166633A

United States Patent [19]

Wang

[11] Patent Number: 6,166,633

[45] **Date of Patent: *Dec. 26, 2000**

[54] PROCESS FOR REDUCING MOTION-TYPE FALSE ALARM OF SECURITY ALARM SYSTEM WITH SELF-ANALYZING AND SELF-ADJUSTING CONTROL

[76] Inventor: Randall Wang, 5209 N. Tyler Ave., Temple City, Calif. 91780

[ * ] Notice: This patent is subject to a terminal disclaimer.

[21] Appl. No.: 09/315,934

[22] Filed: May 21, 1999

[51] Int. Cl.[7] ..... G08B 29/00

[52] U.S. Cl. ..... 340/506; 340/550; 340/507; 340/526; 340/527; 340/529; 340/541; 340/825.06

[58] Field of Search ..... 340/500, 506, 340/507, 511, 526, 527, 529, 541, 565, 825.06, 309.15; 379/39, 40, 44

[56] References Cited

U.S. PATENT DOCUMENTS

| | | | |
|---|---|---|---|
| 4,521,768 | 6/1985 | Haran et al. | 340/566 |
| 4,751,399 | 6/1988 | Koehring et al. | 307/117 |
| 4,764,755 | 8/1988 | Pedtke et al. | 340/541 |
| 4,994,787 | 2/1991 | Kratt et al. | 340/505 |
| 5,057,816 | 10/1991 | Kostusiak et al. | 340/506 |
| 5,428,345 | 6/1995 | Bruno | 340/541 |
| 5,475,365 | 12/1995 | Hoseit et al. | 340/522 |
| 5,686,896 | 11/1997 | Bergman | 340/636 |

*Primary Examiner*—Daryl Pope
*Attorney, Agent, or Firm*—Raymond Y. Chan; David and Raymond

[57] ABSTRACT

An additional logic algorithm is employed in the process for reducing motion-type false alarm of security alarm system automatically or manually, wherein the preset time period of the delaying period of the verification condition is reduced to a shorter first adjusted time period when a second alarm trigger is occurred after the first alarm trigger during the preset time period. If a third alarm trigger is occurred during the first adjusted time period, the delaying period is further reduced to a second adjusted time period shorter than the first adjusted time period. The delaying period will be further reduced when subsequent alarm trigger occurred. However, if there is no third alarm trigger occurred during the first adjusted time period, or there is no subsequent alarm trigger occurred after the last alarm trigger during the latest reduced adjusted time period, the delaying period will be reset to the preset time period.

6 Claims, 2 Drawing Sheets

PROCESS FOR REDUCING MOTION-TYPE FALSE ALARM OF SECURITY ALARM SYSTEM WITH SELF-ANALYZING AND SELF-ADJUSTING CONTROL

FIELD OF THE PRESENT INVENTION

The present invention relates to a process of minimizing false alarm for security alarm system having motion sensors, and more particular to an improvement on a U.S. patent application, application Ser. No. 09/145,403, filed Sep. 2, 1998, now U.S. Pat. No. 5,917,409.

BACKGROUND OF THE PRESENT INVENTION

It is reported that less than 5% of the triggered alarms are caused by actual illegal events. More than 90% of the triggered alarms are false alarms caused by the motion sensors and human mis-operations. False alarms are the unsolved troubles to both the alarm companies and the police resources. Most alarm owners have the unpleasant experience of being awaken in mid-night by the alarm company due to false alarms. Moreover, unaccountable waste of time and police force have been suffered by most of the policemen. Before the policemen arrive at the scene, no one knows whether it is a false alarm or an actual alarm. Therefore, the local police resource charges the alarm owner a pretty high amount for a false alarm operation fee for each false alarm which causes a lot of complaints from users also. It creates a great burden to the limited police force in every city. In fact, millions of expense have been wasted for the police resources in responding to the false alarms, that greatly degrades the efficiency and performance of the police. Accordingly, some of the police stations in this country consider abandoning such alarm response service. It will only be good news to all burglars. Therefore, how to effectively minimize the possibility of false alarm becomes an urgent topic to both the alarm users and the police resources.

Manual verification seems to be the only solution today, that requires the operators in the central station to manually monitor the information received from the additionally installed audio and video verification equipments. However, such audio and video monitoring equipments are too expensive and will not respond automatically by themselves. Generally, the limited manpower in the central station must monitor many clients at one time, so that man made mistakes are unavoidable.

In the previous allowed U.S. Pat. No. 5,917,409 the applicant successfully suggests a novel process and system for reducing motion-type false alarm of security alarm system, which:

1. effectively minimize the possibility of false alarm and substantially prevent the waste of police force as well as the unreasonable false alarm operation fee charged by the police to the alarm owner;
2. renders the security alarm system to an intelligence system that would automatically verify the first detecting signal sent from any of the motion sensors to the control panel;
3. prevents the unreasonable increase of the installation expense of the alarm owner; and
4. avoids false alarm without the manual operation by the central station and the monitoring by the additional video and/or video verification equipment.

In view of the above invention, in the verification condition, the duration of the delaying period of activating the control panel affects the accuracy of the security alarm system. The shorter the delaying period, the more sensitive is the security alarm system with more possibility of having false alarm. The longer the delaying period, the less sensitive is the security alarm system with less possibility of having false alarm. The appropriate duration of the delaying period can be preset by the security companies according to their experience and the actual condition of the place to be monitored. However, the substantial condition of the monitoring area may change from time to time after the duration of the delaying period is set. Accordingly, the applicant further develops a self-analyzing and self-adjusting process for the duration of the delaying period during the verification condition according to the substantial needs, so as to ensure the best security and minimizes the false alarm.

SUMMARY OF THE PRESENT INVENTION

It is thus a main object of the present invention to provide a process for reducing motion-type false alarm of security alarm system that comprises a self-analyzing and self-adjusting control to adjust the duration of the delay period during the verification condition according to the substantial needs, so as to ensure the best security and minimizes the false alarm.

A further object of the present invention is to provide a false alarm reduction analysis and adjustment method for making proper adjustment to the duration of the delaying period during the verification condition of the process and system for reducing motion-type false alarm of security alarm system.

In order to accomplish the above objects, an additional logic algorithm is employed in the process for reducing motion-type false alarm of security alarm system automatically or manually, wherein the preset time period of the delaying period of the verification condition is reduced to a shorter first adjusted time period when a second alarm trigger is occurred after the first alarm trigger during the preset time period. If a third alarm trigger is occurred during the first adjusted time period, the delaying period is further reduced to a second adjusted time period shorter than the first adjusted time period. The delaying period will be further reduced when subsequent alarm trigger occurred. However, if there is no third alarm trigger occurred during the first adjusted time period, or there is no subsequent alarm trigger occurred after the last alarm trigger during the latest reduced adjusted time period, the delaying period will be reset to the preset time period.

DETAILED DESCRIPTION OF THE PREFERRED EMBODIMENT

According to the applicant's previous U.S. patent application, application Ser. No. 09/145,403, filed Sep. 2, 1998, a process for reducing motion-type false alarm of security alarm system is disclosed, which enables the security alarm system to process self-verification steps before calling the police and is adapted to all kind of current security alarm system which comprises a control panel, a local warning system electrically connected to the control panel, a plurality of motion sensors which are respectively installed at different motion detecting areas (monitoring zones) and electrically connected to the control panel, a phone dialing system such as a dialer which is built in the control panel for transmitting digital signals to a central station for dispatching to the designated police resource when it is activated.

Figure 1:
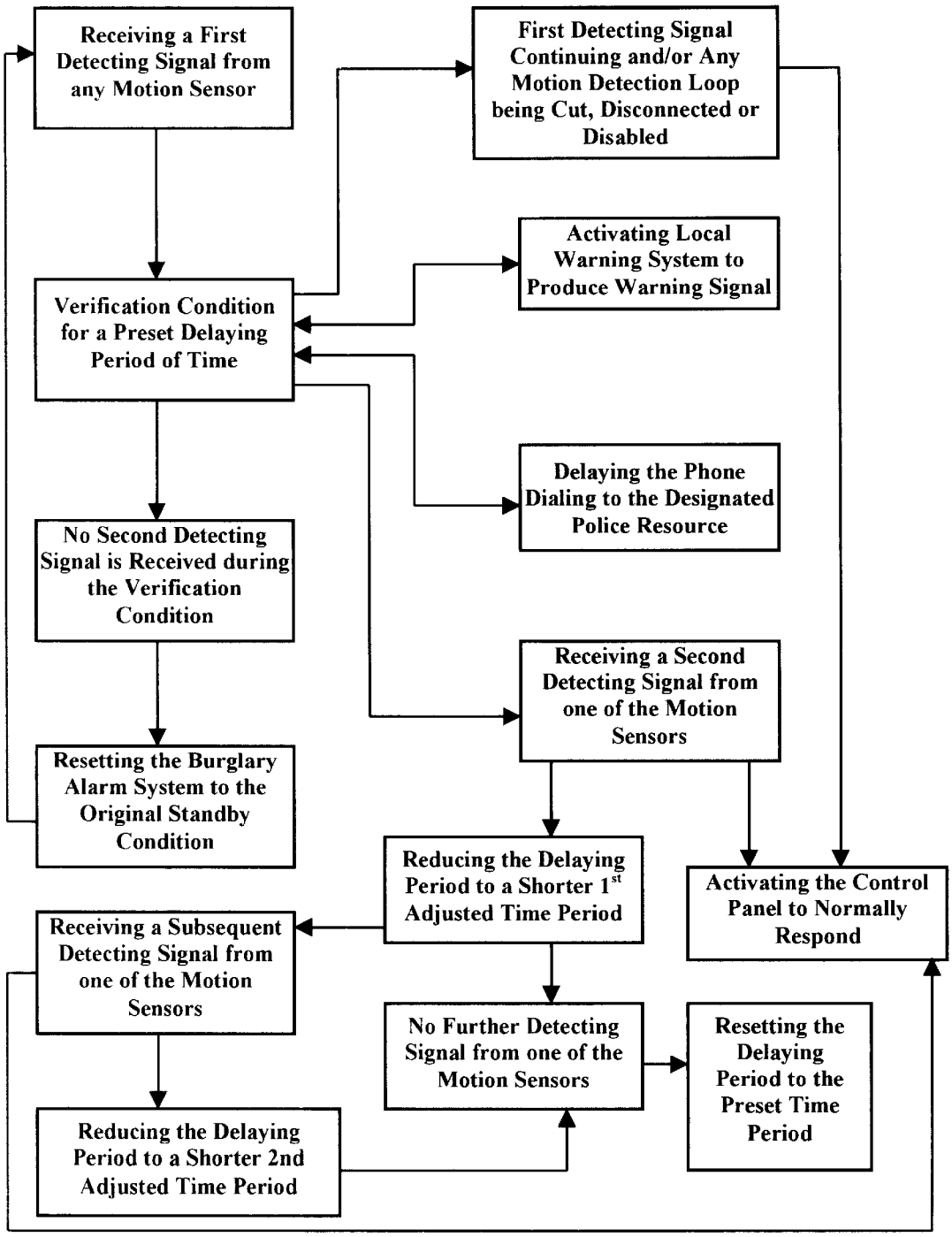
FIG. 1 is a block diagram of a process system for reducing motion-type false alarm of security alarm system with self-analyzing and self-adjusting control according to the present invention.

The process for reducing motion-type false alarm of a security alarm system, which is activated by the alarm user by keying in the security code into an activating and de-activating keypad, as seen in FIG. 1 comprises the steps as follows.

1. Activate the local warning system to produce local warning sound for a predetermined period of time, normally two to five minutes, when any one of the motion sensors detects a first motion everytime within the respective motion detecting area.

2. Delay to activate the control panel as well as the built-in phone dialing system for a preset time period, wherein the security alarm system is in a verification condition during such a delaying period.

3. Activate the control panel to normally respond by activating the local warning system or any other warning systems and, at the same time, the built-in phone dialing system to transmit digital signals to the central station for dispatching to the designated police resource when at least one more detecting signal is sent from one of the motion sensors that detects a second motion within the respective motion detecting area during the verification condition, i.e. within the delaying period.

4. However, if there is no other detecting signal sent from any motion sensor within the predetermined period of time, the security alarm system is reset to the original standby condition. In other words, if there is no second motion detected by any motion sensor during the verification condition, the security alarm system will be automatically reset to the standby condition, so that the standby security alarm system is ready to enter the verification condition again if there is another first motion detected by any of the motion sensors again.

Moreover, in the above step (3), it can be preset in such a manner that the control panel will only be activated to normally respond by activating the local warning system or any other warning systems and, at the same time, the built-in phone dialing system of the control panel transmits digital signals to the central station for dispatching to the designated police resource when at least one more detecting signal is sent from another pre-designated motion sensor.

Furthermore, in step (1), a detecting signal is sent from the motion sensor which detects the motion to the control panel to activate the local warning system to produce the local warning signal. If the particular detecting signal continues transmitting for a predetermined period of time, generally speaking 2 to 5 minutes, the above step (3) will automatically process.

Figure 2:
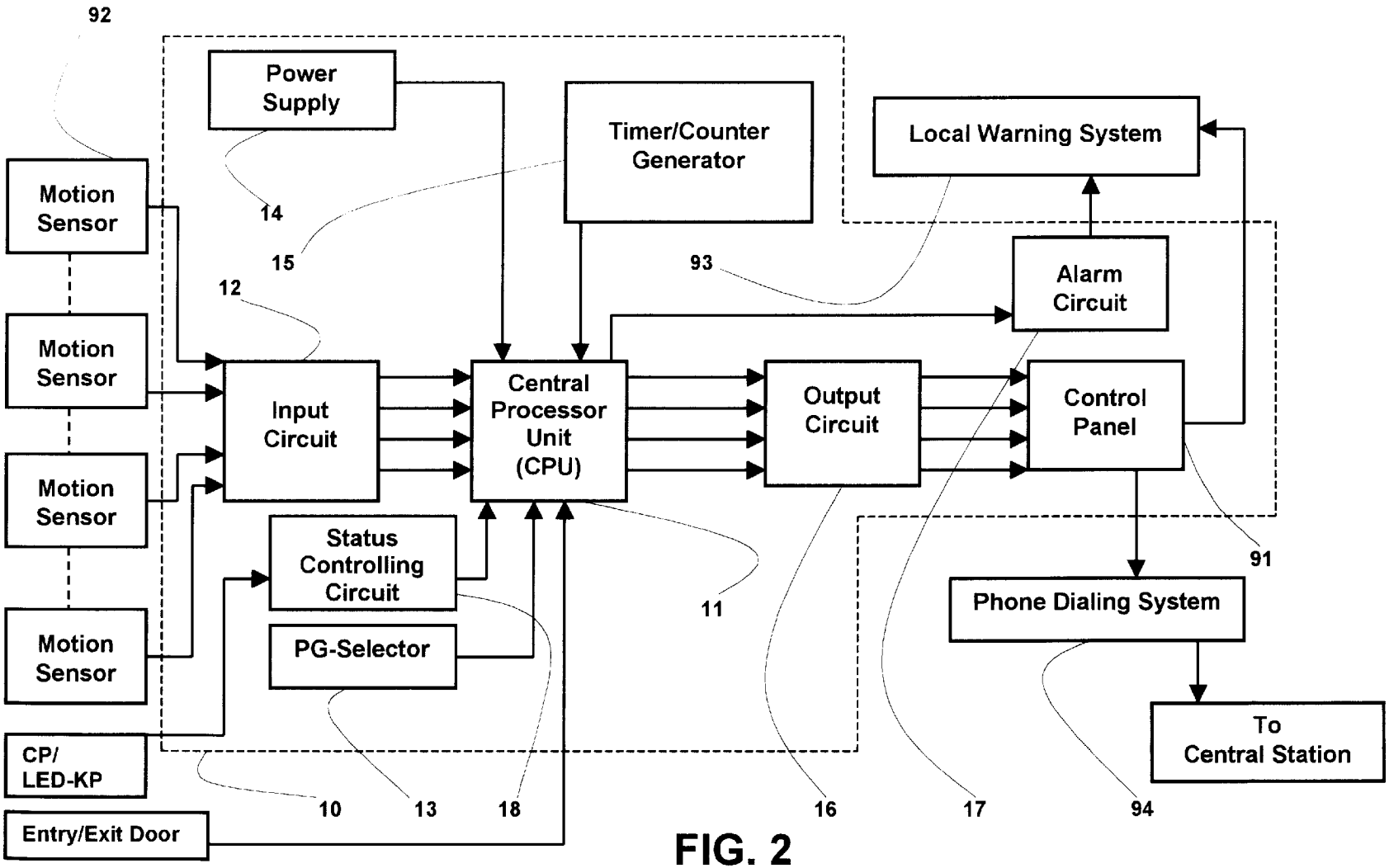
FIG. 2 is a block diagram of a system for reducing motion-type false alarm of security alarm system according to the present invention.

In order to process the above self-verification steps, a self-verification system 10 can either be integrally built-in a control panel or be connected between the control panel 91 and the motion sensors 92 of the conventional security alarm system as disclosed in the previous application, as shown in FIG. 2,. In other words, all the motion sensors 92 are connected to the self-verification system 10 before connecting to the control panel 91, so that all detecting signals sent from the motion sensors 92 will first be detected by the self-verification system 10 which controls whether the detecting signal should be sent to the control panel 91 to trigger the alarm system by activating the local warning system 93 and the phone dialing system 94. Besides, the local warning system 93 is also first connected to the self-verification system 10 before connecting to the control panel 91.

It is worth to describe the self-verification system 10 in this application again, so that no referral to the previous application is needed in order to better understand how the improvement according to the present invention effectively works. The self-verification system 10 for reducing motion-type false alarm of a security alarm system comprises a central processor unit (CPU) 11 which is a central controller for computation and loading designated software for controlling the following associate circuits, an input circuit 12 which is connected with the CPU 11 having a plurality of input terminals for respectively connecting the motion sensors 92 of the security alarm system with the CPU 11, a PG-selector 13 which comprises a switch circuit connected with the CPU 11 for setting the CPU 11 to select and program the standby period and functions of the system 10, a power supply circuit 14 connected with the CPU 11 for purifying electrical power received from the control panel 91 of the security alarm system before sending to the CPU 11 by stabilizing voltage and eliminating interference frequency and noise, a timer/counter generator circuit 15 connected with the CPU 11 for generating counter signals which are pulse signals for counting a preset standby period of the verification condition, an output circuit 16 having a plurality of output terminals with respect to the motion sensors 92 for connecting the CPU 11 with the control panel 91 of the security alarm system, an alarm output 17 connecting the CPU 11 with the local warning system 93, which generally comprises the audible device and visual device, for activating local security electrical actions of the security alarm system, and a status controlling circuit 18 connected with the CPU for notifying the self-verification system 10 whether the security alarm system is in arming or disarming status, wherein the status controlling circuit 18 disables the self-verification system 10 when the security alarm system is in disarming status and activate the self-verification system 10 when the security alarm system is in arming status.

When any of the motion sensors 93 of the standby security alarm system detects a first motion within the respective monitoring zone, a first detecting signal is sent from the corresponding motion sensor 93 to CPU 11 of the self-verification system 10 via the input circuit 12. The first detecting signal will first enter the self-verification system 10 and activate it to the verification condition. Then, the timer/counter generator circuit 15 will start to generate pulse signals for counting the preset standby period. During the counting standby period, the self-verification system is in the verification condition. At that moment, the CPU 11 of the self-verification system 10 holds the first detecting signal here and only triggers the local warning system 93 to provide audible and/or visual signals through the alarm output 17. In other words, during the verification condition, the first detecting signal will not enter and trigger the control panel 91.

If an intruder enters the building and is detected by any one of the motion sensors 92, the intruder would either search around for larceny or try to escape because of the warning sound produced. Therefore, another motion sensor or even the same motion sensor 92 would certainly detect the intruder's activity within the predetermined standby period of time and send out a second detecting signal to the self-verification system 10. When the self-verification system 10 receives two or more detecting signals from the different motion sensors 92 (or even from the same motion sensor 92 under certain circumstances), the self-verification system 10 would immediately trigger the control panel 91 to normally respond by fully activating the local warning system 93 and any other warning system as well as the built-in phone dialing system 94 to transmit digital signals to a central station for dispatching to the designated police resource. In addition, the number of detecting signals required to be received by the self-verification system 10 during the verification condition before the control panel 91 is triggered and the duration of the predetermined period of time for the verification condition can be preset in the self-verification system 10 by the user according to different situations and environments.

According to the present invention, an additional logic algorithm is employed with the above process to provide a self-analyzing and self-adjusting control to the delaying period in the verification condition, so as to ensure the best security and minimizes the false alarm.

The preset time period of the delaying period in step (2) is generally determined by the following equation:

$$X = \frac{\text{Total Square Feet Protected in the Premises}}{\text{Number of Motion Sensors used}}$$

When X<500, the time period is preferred to be set at 5–15 minutes, P1.

When 500≦X≦3000, the time period is preferred to be set at 15–30 minutes, P2.

When X>3000, the time period is preferred to be set at 25–45 minutes, P3.

According to the preferred embodiment of the present invention, a digital time counter for diagnostic counting-up can be employed in the false alarm reduction system and a plurality of delaying periods can be preset in the PG-Selector 13. A plurality of selection buttons can be provided in the false alarm reduction system. For example, three time periods, P1 (5 minutes), P2 (15 minutes) and P3 (25 minutes) can all be preset for selection. The users may select the appropriate time period as the delaying period, P1, P2 or P3, to fit their substantial needs.

Also, proper adjustment can be made by analyzing result with the number of false alarms and the number of actual triggers recorded on DDC or by central station in a specific period of time, 3 months, half a year, or one year. For example, if the original delaying period is preset to P2, 10 minutes.

If the $$\frac{\text{Number of Motion Sensor False Alarms}}{\text{Number of Actual Triggers}} \times 100\% \leq 10\%,$$

the original preset delaying period is all right.

If the $$\frac{\text{Number of Motion Sensor False Alarms}}{\text{Number of Actual Triggers}} \times 100\% \geq 10\%,$$

the original preset delaying period needs to be set to P1 from P2 or to P2 from P3 .

Or that, make other adjustments like replacing with higher quality motion sensors, adjusting motion sensors' locations, and/or improving environment inside the building.

According to the present invention, after receiving the second detecting signal from one of the motion sensors or one of the other motion sensors during preset time period of the delaying period in the verification condition, further comprising the steps of:

(a) reducing the time period of the delaying period in the verification condition in step (2) to a shorter adjusted time period;

(b) activating the control panel to normally respond by activating the local warning system or any other warning systems and, at the same time, the built-in phone dialing system to transmit digital signals to the central station for selectively dispatching to the designated police resource when at least one more subsequent detecting signal is sent from one of the motion sensors that detects a subsequent motion within the respective motion detecting area, and repeating the above (a) to further reduce the time period of the delaying period; and (c) resetting the shorter adjusted time period of the delaying period to the original preset time period when there is no subsequent detecting signal sent from anyone of the motion sensors or any other one of the motion sensors that detects a subsequent motion within the respective motion detecting area.

Practically, the time period of the delaying period in the verification condition determines the sensitivity of the security alarm system. Basically, the shorter the time period of the delaying period, the less secure is the security alarm system while increasing the false alarm reduction ability. In other words, the longer the time period of the delaying period, the more secure is the security alarm system while decreasing the false alarm reduction ability.

For example, the preset time period of the delaying period of the verification condition in step (2) is P3, e.g. 25 minutes. When a first alarm trigger is occurred, i.e. one of the motion sensors detects a motion within the detecting area, the security alarm system is activated to process the step (1) and enters the verification condition in step (2) from the standby condition. When a second alarm trigger is occurred, i.e. another motion sensor or one of any motion sensors detects another motion within the detecting area within the preset time period, P3, of the delaying period during the verification condition, the step (3) is processed and that, the delaying period of the verification condition is switch to P2 (15 minutes), i.e. the shorter first adjusted time period, so as to shorten the time period of the delaying period to increase the false alarm reduction ability.

If there is no subsequent alarm trigger occurred (i.e. no more motion is detected) within the shorter first adjusted time period (P2), the delaying period is reset back to the original default time period, P3. However, if a third alarm trigger is occurred, it means a subsequent motion is detected in the detecting area within the first adjusted time period, P2, the step (3) is processed again. Moreover, the delaying period of the verification condition is further switched to P1 (5 minutes), i.e. the shorter second adjusted time period, so as to further shorten the time period of the delaying period to further increase the false alarm reduction ability.

Moreover, if a fourth, fifth, sixth, and subsequent alarm triggers occurred, the delaying period of the verification condition in step (2) can be further reduced until zero. Similarly, if there is no subsequent alarm trigger occurred (i.e. no more motion is detected) within the next second adjusted time period (P1), the delaying period is reset back to the original default time period, P3.

In order to further verify whether there is an intruder who has broken in the motion detecting areas and cut, disconnected or disabled any of the motion detection loops, an additional step can be included, after the step (2), in the process for reducing motion-type false alarm of a security alarm system, that is to activate the control panel to normally respond by activating local warning system to produce warning signals and the phone dialing system to transmit digital signals to the central station when the motion sensor that detected the first motion continuously sends out a detecting signal for a predetermined period of time, or any one of the motion detection loops is cut, disconnected or disabled.

According to the present invention, the additional logic algorithm provides a self-analyzing and self-adjusting control to the process and system for reducing motion-type false alarm of a security alarm system. It substantially verifies whether the alarm trigger is a false alarm by gradually reduce the delaying period of the verification condition.

What is claimed is:

1. A process for reducing false alarm of a security alarm system, which comprises a control panel, a local warning system electrically connected to the control panel, a plurality of motion sensors which are respectively installed at a plurality of motion detecting areas and electrically connected to the control panel, a phone dialing system being built in the control panel for transmitting digital signals to a central station for dispatching to a designated police resource when the phone dialing system is activated, comprising the steps of:

(a) activating the local warning system to produce a local warning signal for a designated period of time when one of the motion sensors detects a motion everytime within the respective motion detecting area during a standby condition of the security alarm system;

(b) delaying to activate the control panel as well as the phone dialing system for a preset time period, wherein, during such a delaying period, the security alarm system is in a verification condition;

(c) resetting the security alarm system to the original standby condition when there is no other detecting signal sent from any of the pre-designated motion sensors within the predetermined period of time, wherein the standby security alarm system is ready to enter the verification condition again when there is motion detected by any of the motion sensors again;

(d) activating the control panel to normally respond by activating the local warning system to produce warning signals and the phone dialing system to transmit digital signals to the central station when another detecting signal is sent from one of the other pre-designated motion sensors that detects a second motion within the respective motion detecting area within the predetermined period of time during the verification condition;

(e) reducing the preset time period of the delaying period to a shorter adjusted time period when the second motion is detected in the respective motion detecting area within the preset time period of the delaying period during the verification condition of the adjusted time period;

(f) resetting the delaying period from the adjusted time period back to the preset time period when no subsequent motion is detected in the respective motion detecting area within the adjusted time period;

(g) repeating the above step (c) and further reducing the adjusted time period of the delaying period to a second adjusted time period when at least one more subsequent detecting signal is sent from one of the motion sensors that detects a subsequent motion within the respective motion detecting area during the previous adjusted time period; and (h) resetting the delaying period from the adjusted time period back to the original preset time period when no subsequent motion is detected in the respective motion detecting area within the second adjusted time period.

2. A process for reducing false alarm of a security alarm system, as recited in claim 1, wherein the alarm system further comprises at least one motion detection loop, and step (b), further comprising a step of activating the control panel to normally respond by activating the local warning system to produce warning signals and the phone dialing system to transmit digital signals to the central station when the motion sensor that detected the first motion continuously sends out a detecting signal for a predetermined period of time.

3. A process for reducing motion-type false alarm of a security alarm system, as recited in claim 1, wherein the alarm system further comprises at least one motion detection loop, and step (b) further comprising a step of activating the control panel to normally respond by activating the local warning system to produce warning signals and the phone dialing system to transmit digital signals to the central station when any one of the motion detection loops is cut, disconnected or disabled.

4. A process for reducing false alarm of a security alarm system, which comprises a control panel, a local warning system electrically connected to the control panel, a plurality of motion sensors which are respectively installed at a plurality of motion detecting areas and electrically connected to the control panel, a phone dialing system being built in the control panel for transmitting digital signals to a central station for dispatching to a designated police resource when the phone dialing system is activated, comprising the steps of:

(a) activating the local warning system to produce a local warning signal for a designated period of time when one of the motion sensors detects a motion everytime within the respective motion detecting area during a standby condition of the security alarm system;

(b) delaying to activate the control panel as well as the phone dialing system for a preset time period, wherein, during such a delaying period, the security alarm system is in a verification condition;

(c) resetting the security alarm system to the original standby condition when there is no other detecting signal sent from any of the pre-designated motion sensors within the predetermined period of time, wherein the standby security alarm system is ready to enter the verification condition again when there is motion detected by any of the motion sensors again;

(d) activating the control panel to normally respond by activating the local warning system to produce warning signals and the phone dialing system to transmit digital signals to the central station when at least one more detecting signal is sent from one of the motion sensors that detects a second motion within the respective motion detecting area within the predetermined period of time during the verification condition;

(e) reducing the preset time period of the delaying period to a shorter adjusted time period when the second motion is detected in the respective motion detecting area within the preset time period of the delaying period during the verification condition of the adjusted time period;

(f) resetting the delaying period from the adjusted time period back to the original preset time period when no subsequent motion is detected in the respective motion detecting area within the adjusted time period;

(g) repeating the above step (c) and further reducing the adjusted time period of the delaying period to a second adjusted time period when at least one more subsequent detecting signal is sent from one of the motion sensors that detects a subsequent motion within the respective motion detecting area during the previous adjusted time period; and (h) resetting the delaying period from the second adjusted time period back to the original preset time period when no subsequent motion is detected in the respective motion detecting area within the second adjusted time period.

5. A process for reducing motion-type false alarm of a security alarm system, as recited in claim 4, wherein the alarm system further comprises at least one motion detection loop, and step (b), further comprising a step of activating the control panel to normally respond by activating the local warning system to produce warning signals and the phone dialing system to transmit digital signals to the central station when the motion sensor that detected the first motion continuously sends out a detecting signal for a predetermined period of time.

6. A process for reducing motion-type false alarm of a security alarm system, as recited in claim 4, wherein the alarm system further comprises at least one motion detection loop, and step (b) further comprising a step of activating the control panel to normally respond by activating the local warning system to produce warning signals and the phone dialing system to transmit digital signals to the central station when any one of the motion detection loops is cut, disconnected or disabled.

* * * * *